US012467695B2

(12) United States Patent
Sasaki et al.

(10) Patent No.: US 12,467,695 B2
(45) Date of Patent: Nov. 11, 2025

(54) HEAT PIPE STRUCTURE, HEAT SINK, MANUFACTURING METHOD FOR HEAT PIPE STRUCTURE, AND MANUFACTURING METHOD FOR HEAT SINK

(71) Applicant: Furukawa Electric Co., Ltd., Tokyo (JP)

(72) Inventors: Chiyoshi Sasaki, Tokyo (JP); Masakazu Isemura, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 216 days.

(21) Appl. No.: 17/357,736

(22) Filed: Jun. 24, 2021

(65) Prior Publication Data

US 2021/0318075 A1 Oct. 14, 2021

Related U.S. Application Data

(63) Continuation of application No. PCT/JP2019/049731, filed on Dec. 19, 2019.

(30) Foreign Application Priority Data

Jan. 9, 2019 (JP) ..... 2019-002193

(51) Int. Cl.
*F28D 15/02* (2006.01)

(52) U.S. Cl.
CPC ..... *F28D 15/0275* (2013.01); *F28D 15/0233* (2013.01); *F28F 2275/04* (2013.01)

(58) Field of Classification Search
CPC .. F28D 15/0275; F28D 15/0233; F28D 15/04; F28F 2275/04
See application file for complete search history.

(56) References Cited

U.S. PATENT DOCUMENTS 5,826,645 A 10/1998 Meyer et al.
5,983,995 A 11/1999 Shutou et al.
(Continued)

FOREIGN PATENT DOCUMENTS

CN 2465231 Y 12/2001
CN 103026165 A 4/2013
(Continued)

OTHER PUBLICATIONS

English translation of International Preliminary Report on Patentability for Application No. PCT/JP2019/049731, dated Jun. 16, 2021.

(Continued)

*Primary Examiner* — Miguel A Diaz
*Assistant Examiner* — Khaled Ahmed Ali Al Samiri
(74) *Attorney, Agent, or Firm* — Dorsey & Whitney LLP

(57) ABSTRACT

A base block has a longitudinal direction and a width direction and includes a recessed part in which a heat receiving tubular portion is accommodated, and a container part of a heat pipe is caulked and fixed in a recessed part and a first metal part containing first metal having a melting point equal to or higher than 130° C. and equal to or lower than 400° C. and/or a first metal alloy having a melting point equal to or higher than 130° C. and equal to or lower than 400° C. is formed between the recessed part and an outer surface of the container part.

17 Claims, 4 Drawing Sheets

(56) References Cited

U.S. PATENT DOCUMENTS

| | | | | |
|---|---|---|---|---|
| 6,330,739 | B1 | 12/2001 | Ito | |
| 6,830,098 | B1 * | 12/2004 | Todd | F28D 15/0275 165/104.21 |
| 7,036,566 | B1 | 5/2006 | Huang | |
| 2003/0102108 | A1 | 6/2003 | Sarraf et al. | |
| 2003/0218849 | A1 * | 11/2003 | Mochizuki | F28D 15/02 361/103 |
| 2006/0243427 | A1 * | 11/2006 | Kitajima | H01L 23/427 165/104.33 |
| 2006/0243428 | A1 | 11/2006 | Sakayori et al. | |
| 2007/0151711 | A1 | 7/2007 | Chen et al. | |
| 2016/0282054 | A1 | 9/2016 | Hirasawa et al. | |

FOREIGN PATENT DOCUMENTS

| | | | | |
|---|---|---|---|---|
| CN | 203353028 | U | | 12/2013 |
| CN | 204087068 | U | | 1/2015 |
| CN | 105593626 | A | | 5/2016 |
| DE | 102006052753 | A1 | | 1/2008 |
| EP | 3088829 | A1 | | 11/2016 |
| GB | 2278676 | A | | 12/1994 |
| JP | H0513630 | A | * | 1/1993 |
| JP | H07147358 | A | | 6/1995 |
| JP | H1079586 | A | | 3/1998 |
| JP | H11300436 | A | | 11/1999 |
| JP | 2001248982 | A | | 9/2001 |
| JP | 2002090079 | A | | 3/2002 |
| JP | 2002181471 | A | | 6/2002 |
| JP | 2006308240 | A | | 11/2006 |
| JP | 2006322665 | A | | 11/2006 |
| JP | 2007218439 | A | | 8/2007 |
| JP | 2009142890 | A | | 7/2009 |
| JP | 2011169506 | A | * | 9/2011 |
| JP | 2015227768 | A | | 12/2015 |

OTHER PUBLICATIONS

English Translation of Written Opinion for Application No. PCT/JP2019/049731, dated Feb. 10, 2020.

[English Translation] Second Office Action in CN Application No. 201980073624.7, mailed Sep. 29, 2022; pp. all.

English translation of Notice for Reasons for Refusal received in JP Application No. 2019-002193 dated Feb. 8, 2021.

English translation of Notice of Reasons for Refusal received in JP 2019-002193 dated Jun. 14, 2021.

International Search Report and Written Opinion received in PCT/JP2019/049731 dated Feb. 10, 2020 (Engl. translation of ISR only).

[English Translation] Chinese First Office Action dated Mar. 11, 2022 for Chinese Patent Application No. 201980073624.7; pp. all.

Extended European Search Report dated Aug. 31, 2022 in EP application No. 19909142.2; pp. all.

* cited by examiner

HEAT PIPE STRUCTURE, HEAT SINK, MANUFACTURING METHOD FOR HEAT PIPE STRUCTURE, AND MANUFACTURING METHOD FOR HEAT SINK

CROSS REFERENCE TO RELATED APPLICATIONS

The present application is a continuation application of International Patent Application No. PCT/JP2019/049731 filed on Dec. 19, 2019, which claims the benefit of Japanese Patent Application No. 2019-002193, filed on Jan. 9, 2019. The contents of these applications are incorporated herein by reference in their entirety.

TECHNICAL FIELD

The present disclosure relates to a heat pipe structure including a heat pipe, which is a heat transport member in which working fluid is encapsulated on an inside of a decompressed container part, and a base block to which the heat pipe is thermally connected, a heat sink in which a heat radiation fin is provided in the heat pipe of the heat pipe structure, a manufacturing method for the heat pipe structure, and a manufacturing method for the heat sink.

BACKGROUND

As a cooling device used for cooling of control equipment or the like in which a semiconductor element is used, there has been known a cooling device that cools a heat generating body using latent heat at the time when working fluid boils. This cooling device includes, for example, a base block thermally connected to the heat generating body and a heat pipe thermally connected to the base block. The heat pipe is a heat transport member. A container part of the heat pipe is a sealed container and an inside of the container part is subjected to decompression treatment. The working fluid is encapsulated on the inside of the container part. The heat pipe transports heat received from the heat generating body, which is a cooling target, via the base block using latent heat due to a phase change of this working fluid.

When the heat pipe is thermally connected to the base block, in order to give heat transferability from the base block to the heat pipe and fixing stability of the heat pipe to the base block, it is requested to surely fix the heat pipe to the base block while reducing an air gap of a connecting part of the base block and the heat pipe.

As means for thermally connecting the heat pipe to the base block, there are, for example, a connecting method by caulking for accommodating the heat pipe in a heat pipe accommodating part including a recessed part formed in the base block and a pair of wall parts projecting from the recessed part, caulking the pair of wall parts, and thermally connecting the heat pipe to the base block and a connecting method by soldering for accommodating the heat pipe in the recessed part formed in the base block and soldering the heat pipe to the recessed part.

The connecting method by soldering easily reduces the air gap of the connecting part of the base block and the heat pipe. Therefore, the connecting method by soldering is excellent in the heat transferability from the base block to the heat pipe. The heat pipe can be surely fixed to the base block. However, depending on a material of the base block and a material of the heat pipe, in order to connect the heat pipe to the base block, it is necessary to sometimes form a plating film on the base block in advance before the soldering. In the connecting method by soldering, it is necessary to prepare a predetermined amount of solder in a joining part and melt the solder to join the base block and the heat pipe. Therefore, operation is complicated and cost is high. Accordingly, depending on conditions of use and the like of the heat pipe structure, the connecting method by caulking in which it is unnecessary to form an expensive plating film on the base block and joining operation for the base block and the heat pipe is easy is adopted.

As a heat pipe structure in which the heat pipe is thermally connected to the base block by caulking means, for example, there has been proposed a heat pipe structure including a heat pipe, a flat block made of metal, an attachment groove part formed along a surface direction on one surface side of the flat block, one end portion of the heat pipe disposed in the attachment groove part, and a protruding part relatively formed by recessing a vicinity of the attachment groove part in the flat block in a thickness direction, the protruding part being a claw part for fixing bent to an inner side of the attachment groove part and engaged with the one end portion of the heat pipe (Japanese Patent Application Publication No. 2001-248982).

On the other hand, fine unevenness caused, for example, when the recessed part is formed is present on a recessed part inner surface of the base block in which the heat pipe is accommodated. Because of dimension accuracy of the heat pipe and the recessed part, fluctuation in caulking conditions, and the like, when the heat pipe is connected to the base block using the caulking means, an air gap is sometimes formed in a connecting part of the recessed part of the base block and the heat pipe. From the above description, when the heat pipe is connected to the base block by the caulking means, there is room of improvement in the heat transferability from the base block to the heat pipe. With the caulking means, since the air gap is formed in the connecting part of the recessed part of the base block and the heat pipe. Therefore, there is room of improvement in the fixing stability of heat pipe to the base block.

SUMMARY

In view of the circumstances described above, an object of the present disclosure is to provide a heat pipe structure that is excellent in heat transferability from a base block to a heat pipe and excellent in fixing stability of the heat pipe to the base block even if the heat pipe is thermally connected to the base block using caulking means and a heat sink including the heat pipe structure.

A gist of a configuration of the present disclosure is as described below.

[1] A heat pipe structure including:

a base block including a rear surface part thermally connectable to a heat generating body; and a heat pipe including a heat receiving tubular portion fixed to a front surface part of the base block and disposed along an in-plane direction of the base block, wherein the base block has a longitudinal direction and a width direction and includes a recessed part in which the heat receiving tubular portion is accommodated, and a container part of the heat pipe is caulked and fixed in the recessed part and a first metal part containing first metal having a melting point equal to or higher than 130° C. and equal to or lower than 400° C. and/or a first metal alloy having a melting point equal to or higher than 130° C. and equal to or lower than 400° C. is formed between the recessed part and an outer surface of the container part.

[2] The heat pipe structure described in [1], wherein the base block includes the recessed part and a pair of wall parts projecting along an outer circumferential surface of the heat receiving tubular portion from width direction both sides of the recessed part, and the container part of the heat pipe is caulked and fixed to the recessed part and the pair of wall parts.

[3] The heat pipe structure described in [1] or [2], wherein a second metal part containing second metal having a melting point higher than 400° C. and equal to or lower than 1500° C. and/or a second metal alloy having a melting point higher than 400° C. and equal to or lower than 1500° C. is further formed between the outer surface of the container part and the first metal part.

[4] The heat pipe structure described in [3], wherein the second metal part is a plating film formed on the outer surface of the container part.

[5] The heat pipe structure described in any one of [1] to [4], wherein the first metal is tin (Sn) and the first metal alloy is solder.

[6] The heat pipe structure described in any one of [1] to [5], wherein the second metal is at least one type selected out of a group consisting of nickel (Ni) and zinc (Zn).

[7] The heat pipe structure described in any one of [1] to [6], wherein the heat pipe includes a bent part in the longitudinal direction of the container part, and a third metal part containing solder is further formed between the first metal part formed in at least a part of the bent part and the recessed part.

[8] A heat sink including:

a base block including a rear surface part thermally connectable to a heat generating body;

a heat pipe including a heat receiving tubular portion fixed to a front surface part of the base block and disposed along an in-plane direction of the base block and a heat radiating tubular portion communicating with the heat receiving tubular portion and erected from the base block; and a heat radiation fin fixed to the heat radiating tubular portion, wherein the base block has a longitudinal direction and a width direction and includes a recessed part in which the heat receiving tubular portion is accommodated, and a container part of the heat pipe is caulked and fixed in the recessed part and a first metal part containing first metal having a melting point equal to or higher than 130° C. and equal to or lower than 400° C. and/or a first metal alloy having a melting point equal to or higher than 130° C. and equal to or lower than 400° C. is formed between the recessed part and an outer surface of the container part.

[9] The heat sink described in [8], wherein the base block includes the recessed part and a pair of wall parts projecting along an outer circumferential surface of the heat receiving tubular portion from width direction both sides of the recessed part, and the container part of the heat pipe is caulked and fixed to the recessed part and the pair of wall parts.

[10] The heat sink described in [8] or [9], wherein a second metal part containing second metal having a melting point higher than 400° C. and equal to or lower than 1500° C. and/or a second metal alloy having a melting point higher than 400° C. and equal to or lower than 1500° C. is further formed between the outer surface of the container part and the first metal part.

[11] A manufacturing method for a heat pipe structure, including:

a base block forming step of forming, on a front surface part of a base block, a recessed part having a longitudinal direction and a width direction and forming a pair of wall parts projecting in a thickness direction of the base block from width direction both sides of the recessed part;

a caulking step of preparing a heat pipe including a heat receiving tubular portion, the heat pipe including a first plating film formed on an outer surface of a container part of the heat pipe and containing first metal having a melting point equal to or higher than 130° C. and equal to or lower than 400° C. and/or a first metal alloy having a melting point equal to or higher than 130° C. and equal to or lower than 400° C. and, in a state in which the heat receiving tubular portion is accommodated in the recessed part, caulking the pair of wall parts and fixing the heat pipe to the base block; and a heating step of performing heating treatment of the heat pipe fixed to the base block at temperature equal to or higher than 130° C. and equal to or lower than 400° C., melting the first plating film, and forming a first metal part between the recessed part and the outer surface of the container part.

[12] The manufacturing method for the heat pipe structure described in [11], wherein a second plating film containing second metal having a melting point higher than 400° C. and equal to or lower than 1500° C. and/or a second metal alloy having a melting point higher than 400° C. and equal to or lower than 1500° C. is further formed between the outer surface of the container part and the first plating film, and the second plating film forms a second metal part located between the outer surface of the container part and the first metal part.

[13] The manufacturing method for the heat pipe structure described in [11] or [12], wherein, in the heating step, solder provided in at least a part of the recessed part is melted to form a third metal part.

[14] A manufacturing method for a heat sink, including:

a base block forming step of forming, on a front surface part of a base block, a recessed part having a longitudinal direction and a width direction and forming a pair of wall parts projecting in a thickness direction of the base block from width direction both sides of the recessed part;

a caulking step of preparing a heat pipe including a heat receiving tubular portion and a heat radiating tubular portion communicating with the heat receiving tubular portion, the heat pipe including a first plating film formed on an outer surface of a container part of the heat pipe and containing first metal having a melting point equal to or higher than 130° C. and equal to or lower than 400° C. and/or a first metal alloy having a melting point equal to or higher than 130° C. and equal to or lower than 400° C. and, in a state in which the heat receiving tubular portion is accommodated in the recessed part and the heat radiating tubular portion is erected from the base block, caulking the pair of wall parts and fixing the heat pipe to the base block;

a heating step of performing heating treatment of the heat pipe fixed to the base block at temperature equal to or higher than 130° C. and equal to or lower than 400° C., melting the first plating film, and forming a first metal part between the recessed part and the outer surface of the container part; and a heat radiation fin attaching step of attaching a heat radiation fin to the heat radiating tubular portion of the heat pipe fixed to the base block in a state in which the first metal part is formed.

[15] The manufacturing method for the heat sink described in [14], wherein a second plating film containing second metal having a melting point higher than 400° C. and equal to or lower than 1500° C. and/or a second metal alloy having a melting point higher than 400° C. and equal to or lower than 1500° C. is further formed between the outer surface of the container part and the first plating film, and the second plating film forms a second metal part located between the outer surface of the container part and the first metal part.

[16] The manufacturing method for the heat sink described in [14] or [15], wherein, in the heating step, solder provided in at least a part of the recessed part is melted to form a third metal part.

In an aspect of the heat pipe structure in [1] described above, since the heat receiving tubular portion of the heat pipe is caulked and fixed in the recessed part of the base block, the heat pipe is thermally connected to the base block. The first metal part is formed between the recessed part of the base block and the container part outer surface of the heat receiving tubular portion of the heat pipe. That is, the first metal part is formed in a part where the heat pipe is caulked and fixed to the base block. The first metal part is advanced into an air gap formed between the recessed part of the base block and the container part outer surface of the heat receiving tubular portion of the heat pipe.

In an aspect of the heat pipe structure in [3] described above, in the part where the heat pipe is caulked and fixed to the base block, a laminated structure is formed in order of the container part outer surface of the heat receiving tubular portion of the heat pipe, the second metal part, and the first metal part.

According to the aspect of the heat pipe structure of the present disclosure, since the first metal part is advanced into the air gap formed between the recessed part of the base block and the container part outer surface of the heat receiving tubular portion of the heat pipe, the gap is in a state filled by the first metal part. Therefore, even if the heat pipe is thermally connected to the base block using caulking means, it is possible to obtain the heat pipe structure excellent in heat transferability from the base block to the heat pipe in a caulking and fixing part and excellent in fixing stability of the heat pipe to the base block. Since the heat radiation fin, which is heat exchanging means, is attached to the heat pipe structure, even if the heat pipe is thermally connected to the base block using the caulking means, it is possible to obtain the heat sink excellent in heat transferability from the base block to the heat pipe in the caulking and fixing part and excellent in fixing stability of the heat pipe to the base block.

According to the aspect of the heat pipe structure of the present disclosure, the first metal part in an advanced state into the air gap is formed while preventing, since the melting point of the first metal or the first metal alloy forming the first metal part is equal to or higher than 130° C., melting of the first metal part due to a heat generation temperature of the heat generating body, which is a cooling target, and preventing, since the melting point is equal to or lower than 400° C., damage to the heat pipe.

Since the first metal part described above is formed, even if the bent part, fixing of which by caulking is difficult, is provided in the heat receiving tubular portion of the heat pipe, it is possible to improve the heat transferability from the base block to the heat pipe over the entire heat receiving tubular portion including the bent part because the first metal part is formed in the air gap formed between the bent part of the heat receiving tubular portion and the recessed part of the base block.

According to the aspect of the heat pipe structure of the present disclosure, since the laminated structure is formed in the order of the container part outer surface of the heat receiving tubular portion of the heat pipe, the second metal part, and the first metal part, it is possible to impart a further function to the container part outer surface by action of the second metal part while the air gap is filled by the first metal part.

According to the aspect of the heat pipe structure of the present disclosure, since the first metal is tin (Sn) and the first metal alloy is solder, the first metal part in an advanced state into the air gap is formed while surely preventing melting of the first metal part due to the heat generation temperature of the heat generating body and surely preventing damage to the heat pipe.

According to the aspect of the heat pipe structure of the present disclosure, since the second metal is at least one type selected out of a group consisting of nickel (Ni) and zinc (Zn), it is possible to impart electrolytic corrosion resistance to the container part outer surface.

According to the aspect of the heat pipe structure of the present disclosure, since the third metal part containing solder is further formed between the first metal part and the recessed part of the base block, the air gap formed between the bent part of the heat receiving tubular portion and the recessed part of the base block is surely filled by the first metal part and the third metal part. Therefore, the heat transferability from the base block to the heat pipe in the caulking and fixing part is further improved.

Since the third metal part described above is formed, even if the bent part, fixing of which by caulking is difficult, is provided in the heat receiving tubular portion of the heat pipe, it is possible to surely improve the heat transferability from the base block to the heat pipe over the entire heat receiving tubular portion because not only the first metal part but also the third metal part is formed in the air gap formed between the bent part of the heat receiving tubular portion and the recessed part of the base block.

BRIEF DESCRIPTION OF DRAWINGS

FIG. 5A is an explanatory view of a state in which a heat pipe is caulked and fixed to a base block, FIG. 5B is an explanatory view of a state in which heating treatment is performed after the caulking and fixing and the heat pipe structure is manufactured, and FIG. 5C is an explanatory view of a state in which a heat radiation fin is attached to the heat pipe structure and the heat sink is manufactured.

DETAILED DESCRIPTION

Figure 1:
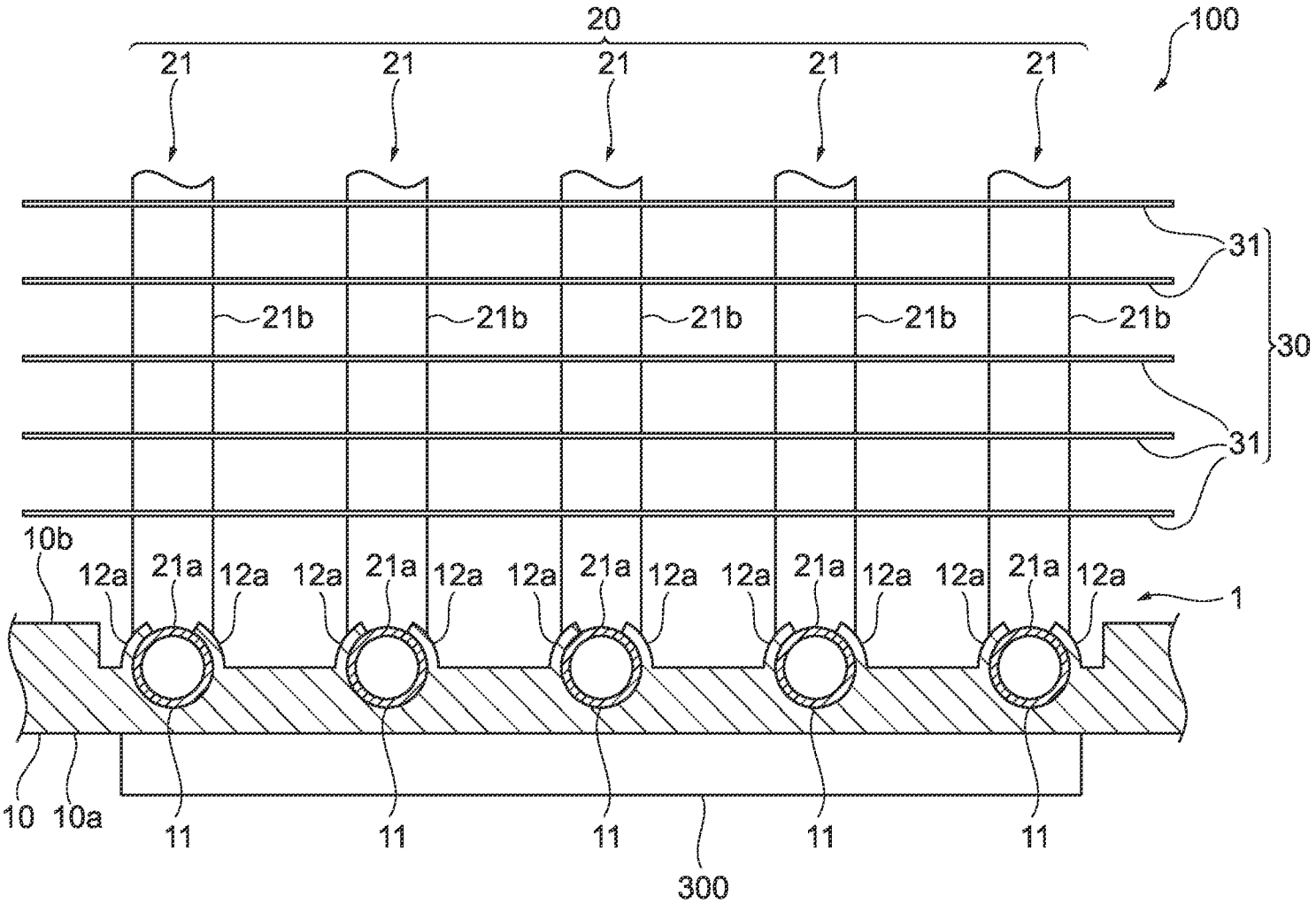
FIG. 1 is an explanatory view of a heat sink in which a heat pipe structure according to an embodiment example of the present disclosure is used.
Figure 2:
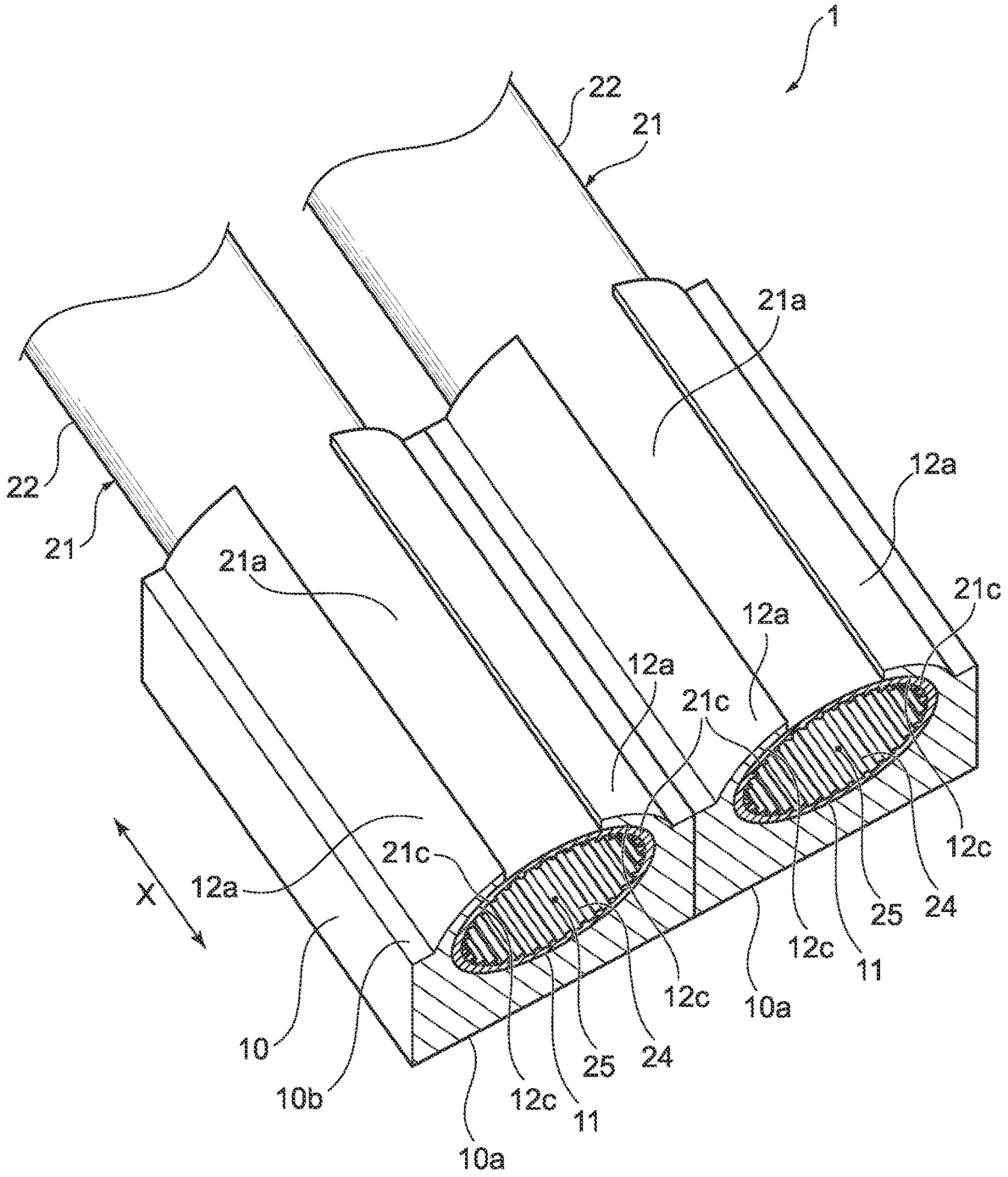
FIG. 2 is an explanatory view schematically showing a cross section of the heat pipe structure according to the embodiment example of the present disclosure.
Figure 3:
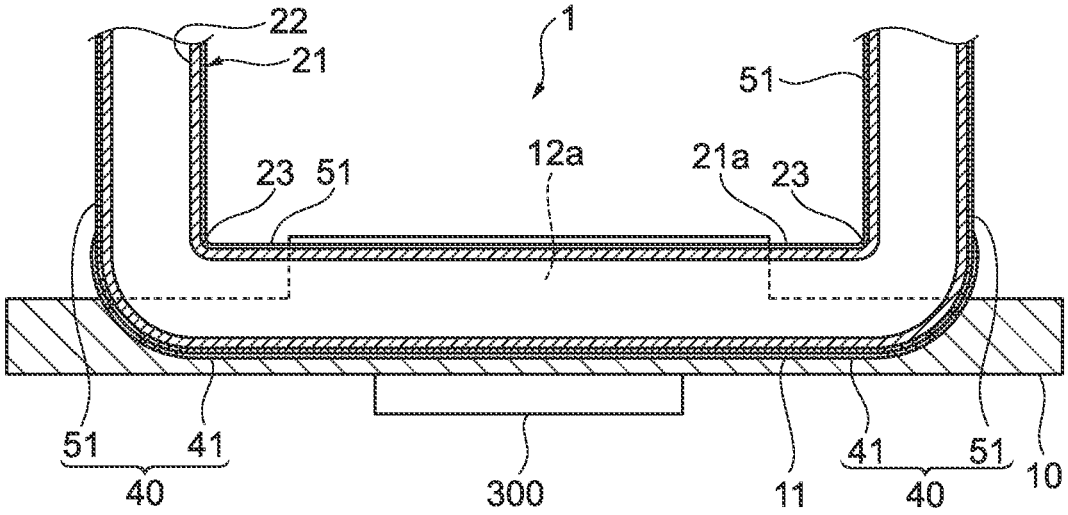
FIG. 3 is a side sectional view of the heat pipe structure according to the embodiment example of the present disclosure.
Figure 4:
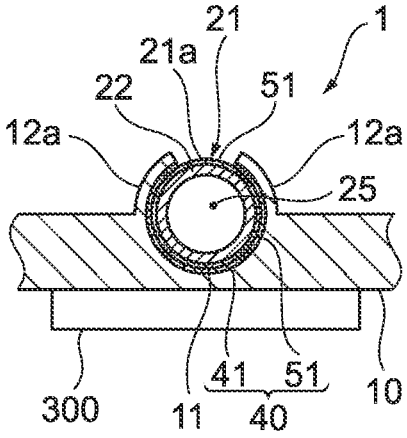
FIG. 4 is a front sectional view of the heat pipe structure according to the embodiment example of the present disclosure.

A heat pipe structure according to an embodiment example of the present disclosure and a heat sink in which the heat pipe structure is used are explained below with reference to the drawings. FIG. 1 is an explanatory view of the heat sink in which the heat pipe structure according to the embodiment example of the present disclosure is used. FIG. 2 is an explanatory view schematically showing a cross section of the heat pipe structure according to the embodiment example of the present disclosure. FIG. 3 is a side sectional view of the heat pipe structure according to the embodiment example of the present disclosure. FIG. 4 is a front sectional view of the heat pipe structure according to the embodiment example of the present disclosure.

First, the heat pipe structure according to the embodiment example of the present disclosure is explained. As shown in FIGS. 1 and 2, a heat pipe structure 1 includes a base block 10 including a rear surface part 10*a* thermally connectable to a heat generating body 300 and a front surface part 10*b* opposed to the rear surface part 10*a* and a heat pipe 21 including a heat receiving tubular portion 21*a* fixed to the front surface part 10*b* of the base block 10 and disposed along an in-plane direction of the base block 10.

The base block 10 has a longitudinal direction and a width direction. A shape of the base block 10 is not particularly limited. However, in the heat pipe structure 1, the base block 10 is a tabular member having predetermined thickness. A shape in a plan view of the base block 10 is a rectangular shape. The rear surface part 10*a* and the front surface part 10*b* are main surfaces of the base block 10. Note that "plan view" means a state in which the base block 10 is visually recognized from an orthogonal direction with respect to a heat transport direction in the heat receiving tubular portion 21*a* of the heat pipe 21 and from a direction opposed to the front surface part 10*b*.

The front surface part 10*b* of the base block 10 includes a recessed part 11, which is a strip groove in which the heat receiving tubular portion 21*a* of the heat pipe 21 is accommodated, and a pair of wall parts 12*a*, 12*a* projecting along an outer circumferential surface of the heat receiving tubular portion 21*a* from both sides in the orthogonal direction (thereafter, sometimes referred to as "width direction") with respect to the longitudinal direction of the recessed part 11. Since a container part 22 of the heat receiving tubular portion 21*a* is caulked and fixed to the recessed part 11 and the pair of wall parts 12*a*, 12*a*, the heat pipe 21 is caulked and fixed to the base block 10.

In the heat pipe structure 1, the recessed part 11 extends, for example, in the longitudinal direction of the base block 10 along an in-plane direction of the base block 10. A shape in the longitudinal direction of the recessed part 11 corresponds to a shape in the longitudinal direction of the heat receiving tubular portion 21*a*. A shape in the width direction of the recessed part 11 corresponds to a shape of a substantially lower half in a shape in the width direction of the heat receiving tubular portion 21*a*, that is, corresponds to a shape of a substantial half on the base block 10 side. Note that, in the heat pipe structure 1, the shape in the longitudinal direction of the heat receiving tubular portion 21*a* is a linear shape and a shape of a width direction cross section of the container 22 in the heat receiving tubular portion 21*a* is a substantially circular shape.

As shown in FIG. 2, like the recessed part 11, the pair of wall parts 12*a*, 12*a* is provided along the in-plane direction of the base block 10. For example, the wall part 12*a* extends along an extending direction of the recessed part 11 and extends in parallel to the extending direction of the recessed part 11. The pair of wall parts 12*a*, 12*a* projects toward an upward direction of the recessed part 11 in a width direction cross section and is bent toward a width direction center of the recessed part 11 to come close to each other. The pair of wall parts 12*a*, 12*a* is formed as a pair of ridge parts projecting along an outer circumferential surface 21*c* of the heat receiving tubular portion 21*a* opposed to the pair of wall parts 12*a*, 12*a* and extending along the longitudinal direction of the heat receiving tubular portion 21*a* (an X direction in FIG. 2). The pair of ridge parts respectively includes press contact surfaces 12*c* that are in press contact with the outer circumferential surface 21*c* of the heat receiving tubular portion 21*a* opposed to the pair of ridge parts. Since the pair of ridge parts includes a pair of press contact surfaces 12*c*, 12*c*, a contact area of the pair of ridge parts and the heat receiving tubular portion 21*a* increases and adhesion between the base block 10 and the heat pipe 21 is improved.

The heat pipe 21 includes the container part 22 having a tube shape, an end face at one end and an end face at another end of which are sealed, a wick structure 24 provided on an inside of the container part 22, and working fluid encapsulated in a hollow part 25, which is an internal space of the container part 22. The hollow part 25 of the container part 22 is a sealed space and is subjected to decompression treatment. A material of the container part 22 is not particularly limited. Examples of the material of the container part 22 include copper, a copper alloy, aluminum, an aluminum alloy, and stainless steel. The working fluid can be selected as appropriate according to compatibility with the material of the container part 22. Examples of the working fluid include water, alternative freon, perfluorocarbon, and cyclopentane. The wick structure 24 is not particularly limited if the wick structure 24 is a structure that generates capillarity. Examples of the wick structure 24 include a plurality of thin grooves (grooves) extending along the longitudinal direction of the container part 22, a sintered body of metal power, and a metal mesh. Note that, in FIG. 2, the groove is used as the wick structure 24 from a viewpoint of preventing an increase in circular current resistance of the working fluid in a liquid phase.

As shown in FIGS. 3 and 4, a second metal part 51 containing second metal having a melting point higher than 400° C. and equal to or lower than 1500° C. and/or a second meat alloy having a melting point higher than 400° C. and equal to or lower than 1500° C. is formed on an outer surface of the container part 22. In the heat pipe structure 1, a shape of the second metal part 51 is a layered shape. The second metal part 51 covers the outer surface of the container part 22 including the heat receiving tubular portion 21*a*. A further function can be imparted to the container part 22 outer surface by action of the second metal part 51. A metal type of the second metal part 51 can be selected according to a type of the further function imparted to the container 22 outer surface. Average thickness of the second metal part 51 is not particularly limited. Examples of the average thickness of the second metal part 51 include a range of 1.0 μm to 20 μm. In the heat pipe structure 1, the second metal part 51 is, for example, a plating film (a second plating film) formed on the outer surface of the container part 22. The second metal part 51 may be directly formed on the outer surface of the container part 22 or may be formed on the outer surface of the container part 22 via another layer. In the heat pipe structure 1, the second metal part 51 is directly formed on the outer surface of the container part 22.

A metal type of the second metal is not particularly limited if the melting point is higher than 400° C. and equal to or lower than 1500° C. Examples of the second metal include nickel (Ni) and zinc (Zn). The second metal alloy is not particularly limited if the melting point is higher than 400° C. and equal to or lower than 1500° C. Examples of the second metal alloy include a nickel (Ni) alloy, a copper (Cu) alloy, and a zinc (Zn) alloy. Since the second metal and the second metal alloy are the metal types described above, electrolytic corrosion resistance can be imparted to the container part 22. Since the electrolytic corrosion resistance is imparted to the container part 22, even if moisture adheres to the heat pipe 21, electrolytic corrosion of the container part 22 can be prevented.

The second metal part 51 only has to contain the second metal and/or the second metal alloy having the melting point higher than 400° C. and equal to or lower than 1500° C. The second metal part 51 may be a member made of the second metal and/or the second metal alloy.

As shown in FIGS. 3 and 4, a first metal part 41 containing the first metal having the melting point equal to or higher than 130° C. and equal to or lower than 400° C. and/or the first metal alloy having the melting point equal to or higher than 130° C. and equal to or lower than 400° C. is formed between the recessed part 11 and the outer surface of the container part 22. The first metal part 41 is a metal material having a melting point lower than the melting point of the second metal part 51. A shape of the first metal part 41 is a layered shape. The first metal part 41 is formed between the second metal part 51 and the recessed part 11. That is, the first metal part 41 is formed between a substantial half on the base block 10 side in the container prat 22 and the recessed part 11. From the above description, a metal laminate part 40 including the first metal part 41 and the second metal part 51 is provided between the substantial half on the base block 10 side in the container part 22 and the recessed part 11. Note that the first metal part 41 only has to be provided between the substantial half on the base block 10 side in the container part 22 and the recessed part 11. As shown in FIGS. 3 and 4, the first metal part 41 may extend from between the substantial half on the base block 10 side in the container part 22 and the recessed part 11 to between the container part 22 and the pair of wall parts 12*a*, 12*a*. That is, the first metal part 41 may be provided not only between the container part 22 and the recessed part 11 but also between the container part 22 and the pair of wall parts 12*a*, 12*a*.

Average thickness of the first metal part 41 is not particularly limited. Examples of the average thickness of the first metal part 41 includes a range of 1.0 μm to 20 μm. In the heat pipe structure 1, as explained below, the first metal part 41 is derived from, for example, the plating film (a first plating film) formed on the outer surface of the second metal part 51, which is a second plating film. The first metal part 41 is formed directly on the outer surface of the second metal part 51 or may be formed on the outer surface of the second metal part 51 via another layer. In the heat pipe structure 1, the first metal part 41 is directly formed on the outer surface of the second metal part 51.

The melting point of the first metal and the first metal alloy is not particularly limited if the melting point is equal to or higher than 130° C. and equal to or lower than 400° C. Since the melting point of the first metal and the first metal alloy is equal to or higher than 130° C. and equal to or lower than 400° C., the first metal part 41 in a state advanced into an air gap formed between the recessed part 11 of the base block 10 and the heat receiving tubular portion 21*a* of the heat pipe 21 without damaging the heat pipe 21 while preventing the first metal part 41 from being melted by heat of the heat generating body 300 thermally connected to the base block 10. A lower limit value of the melting point of the first metal and the first metal alloy is preferably 180° C. and particularly preferably 200° C. from a viewpoint of surely preventing the first metal part 41 from being melted by the heat of the heat generating body 300 thermally connected to the base block 10. On the other hand, an upper limit value of the melting point of the first metal and the first metal alloy is preferably 280° C. and particularly preferably 250° C. from a viewpoint of surely forming the first metal part 41 in the advanced state into the air gap without damaging the heat pipe 21.

The first metal part 41 only has to contain the first metal and/or the first metal alloy having the melting point equal to or higher than 130° C. and equal to or lower than 400° C. The first metal part 41 may be a member made of the first metal and/or the first metal alloy.

In the heat pipe structure 1, the first metal part 41 containing the first metal and/or the first metal alloy having the melting point equal to or higher than 130° C. and equal to or lower than 400° C. is advanced into the air gap formed between the recessed part 11 of the base block 10 and the heat receiving tubular portion 21*a* of the heat pipe 21 including bent parts 23 on the longitudinal direction both sides of the heat receiving tubular portion 21*a*. That is, the air gap is in a filled state by the first metal part 41. Therefore, in the heat pipe structure 1, even if the heat pipe 21 is thermally connected to the base block 10 using caulking means, the heat pipe structure 1 is excellent in heat transferability from the base block 10 to the heat pipe 21 in a caulking and fixing part. As a result, a cooling characteristic of the heat pipe structure 1 is improved. In the heat pipe structure 1, since the air gap is in the filled state by the first metal part 41, the heat pipe structure 1 is excellent in fixing stability of the heat pipe 21 to the base block 10.

Since the first metal part 41 is formed, even if the bent parts 23, fixing of which by caulking is difficult, are provided in the heat receiving tubular portion 21*a* of the heat pipe 21, the first metal part 41 is formed in the air gap formed between the bent parts 23 of the heat receiving tubular portion 21*a* and the recessed part 11 of the base block 10. Therefore, it is possible to improve heat transferability from the base block 10 to the heat pipe 21 over the entire heat receiving tubular portion 21*a* including the bent parts 23. As a result, the cooling characteristic of the heat pipe structure 1 is improved.

In the heat pipe structure 1, since the metal laminate part 40 formed in order of the second metal part 51 and the first metal part 41 is provided on the container part 22 outer surface of the heat receiving tubular portion 21*a*, a further function (in the heat pipe structure 1, electrolytic corrosion resistance) can be imparted to the container part 22 outer surface by the action of the second metal 51 while the air gap is filled by the first metal part 41.

A metal type of the first metal is not particularly limited if the melting point is equal to or higher than 130° C. and equal to or lower than 400° C. Examples of the first metal include tin (Sn) from a viewpoint of forming the first metal part 41 in the advanced state into the air gap while surely preventing melting of the first metal part 41 due to heat generation of the heat generating body 300 and surely preventing damage to the heat pipe 21. A metal type of the first metal alloy is not particularly limited if the melting point is equal to or higher than 130° C. and equal to or lower than 400° C. Examples of the first metal alloy include a tin (Sn) alloy and solder (for example, a tin alloy and a lead alloy) from a viewpoint of forming the first metal part 41 in the advanced state into the air gap while surely preventing melting of the first metal part 41 due to heat generation of the heat generating body 300 and surely preventing damage to the heat pipe 21.

Thereafter, an aspect in which the heat pipe structure 1 according to the embodiment example of the present disclosure is used as a cooling device in a form of a heat sink is explained. As shown in FIG. 1, a heat sink 100 includes the heat pipe structure 1 according to the embodiment example including the base block 10 including the rear surface part 10*a* thermally connected to the heat generating body 300, which is the cooling target, and the heat pipe 21 fixed to the front surface part 10*b* of the base block 10. The heat pipe 21 includes the heat receiving tubular portion 21*a* disposed along the in-plane direction of the base block 10 and a heat radiating tubular portion 21*b* connected to and communicating with the heat receiving tubular portion 21*a* and erected from the base block 10. In the heat sink 100, a heat pipe group 20 including a plurality of heat pipes 21 is formed. The heat sink 100 includes a heat radiation fin group 30 formed by a plurality of heat radiation fins 31, 31, . . . fixed to the heat radiating tubular portion 21*b* in parallel to an erected direction of the heat pipe group 20, that is, an extending direction of the heat radiating tubular portion 21*b*. From the above description, the heat sink 100 has structure in which the heat radiation fins 31 are fixed to the heat radiating tubular portion 21*b* of the heat pipe 21 provided in the heat pipe structure 1.

The plurality of heat pipes 21, 21, . . . forming the heat pipe group 20 are arranged in parallel at predetermined intervals. A shape in the longitudinal direction (a heat transport direction) of the heat pipe 21 is a linear shape, a shape having bent parts, or the like and is not particularly limited. For example, in FIG. 1, the heat pipe 21 is formed by a tubular body having a substantially U shape, which is a shape having bent parts on both sides of the heat receiving tubular portion 21*a*.

The heat receiving tubular portion 21*a*, a shape in the longitudinal direction of which is a linear shape, has a function of a heat receiving part heated by heat from the base block 10. The heat radiating tubular portion 21*b* has a function of a heat radiating part that emits heat transported from the heat receiving tubular portion 21*a* to the heat radiating tubular portion 21*b*. In the heat sink 100, the shape in the longitudinal direction of the heat radiating tubular portion 21*b* is a linear shape.

The plurality of heat radiation fins 31, 31, . . . forming the heat radiation fin group 30 are provided in parallel at predetermined intervals in the extending direction of the heat radiating tubular portion 21*b*. For example, in the heat sink 100, the respective heat radiation fins 31 are provided in parallel such that principal planes of the plurality of heat radiation fins 31, 31, . . . are substantially parallel. The heat radiation fin 31 includes a hole part corresponding to a position, a shape, and a dimension of the heat radiating tubular portion 21*b* of the heat pipe 21. For example, the heat radiation fin 31 is fixed to the heat pipe 21 by fitting and inserting the heat radiating tubular portion 21*b* into the hole part. The heat radiation fin 31 has a function of heat exchanging means for emitting heat from the heat radiating tubular portion 21*b*.

Thereafter, a mechanism of heat transport by the heat sink 100 in which the heat pipe structure 1 is used is explained. When the base block 10 of the heat sink 100 receives heat from the heat generating body 300 in the rear surface part 10*a*, the heat is transferred from the rear surface part 10*a* to the front surface part 10*b* of the base block 10. The heat transferred to the front surface part 10*b* is transferred from the front surface part 10*b* to the heat receiving tubular portion 21*a* of the heat pipe 21. When the heat is transferred to the heat receiving tubular portion 21*a*, the heat receiving tubular portion 21*a* functions as a heat receiving part (an evaporating part) of the heat pipe 21. The working fluid inside the heat pipe 21 changes from a liquid phase to a gas phase in the heat receiving part. The working fluid changed to the gas phase flows, inside the heat pipe 21, from the heat receiving part to a heat radiating part (a condensing part) of the heat radiating tubular portion 21*b* in the longitudinal direction of the heat pipe 21, whereby the heat from the heat generating body 300 is transported from the heat receiving part to the heat radiating part of the heat pipe 21. The working fluid in the gas phase changes to the liquid phase in the heat radiating part of the heat radiating tubular portion 21*b* in which the heat radiation fin 31, which is the heat exchanging means, is provided, whereby the heat transported from the heat receiving part to the heat radiating part of the heat pipe 21 is emitted as latent heat.

From the above description, since the heat sink 100 in which the heat radiation fin 31, which is the heat exchanging means, is attached to the heat pipe structure 1 is adopted, even if the heat pipe 21 is thermally connected to the base block 10 using the caulking means, the heat sink 100 is excellent in heat transferability from the base block 10 to the heat pipe 21 in the caulking and fixing part. As a result, a cooling characteristic of the heat sink 100 is improved. The heat sink 100 excellent in fixing stability of the heat pipe 21 to the base block 10 can be obtained.

Figure 5C:
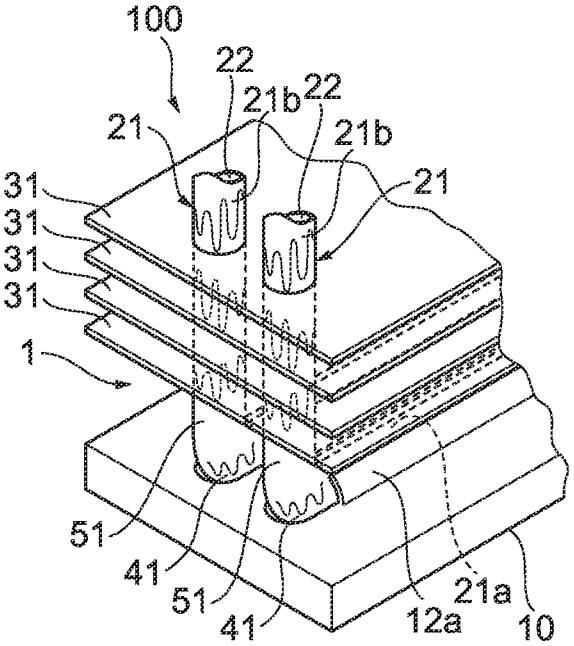
FIGS. 5A-C are explanatory views of manufacturing the heat sink using the heat pipe structure according to the embodiment example of the present disclosure.
Figure 5B:
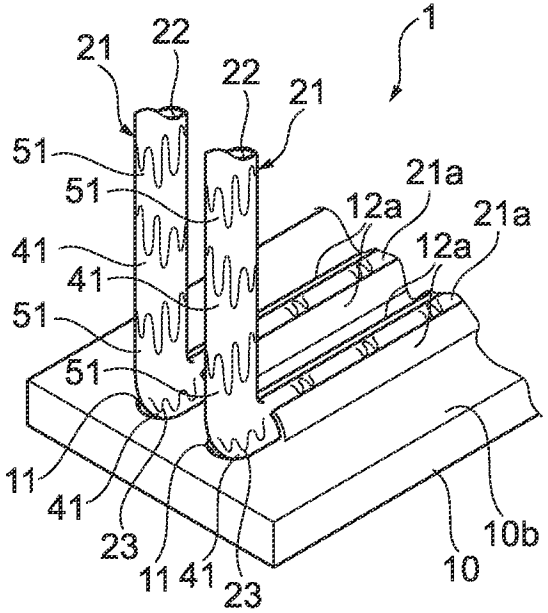
Figure 5A:
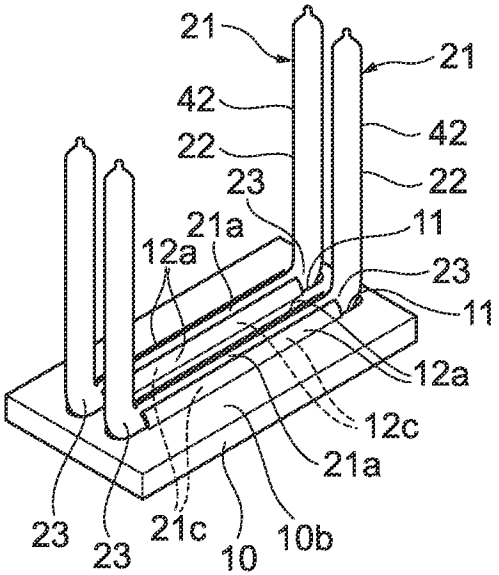

Thereafter, a manufacturing method for the heat pipe structure 1 and a manufacturing method for the heat sink 100 in which the heat pipe structure 1 is used are explained with reference to the drawings. FIGS. 5A-C are explanatory views of manufacturing the heat sink using the heat pipe structure according to the embodiment example of the present disclosure. FIG. 5A is an explanatory view of a state in which the heat pipe is caulked and fixed to the base block, FIG. 5B is an explanatory view of a state in which heating treatment is performed after the caulking and fixing and the heat pipe structure is manufactured, and FIG. 5C is an explanatory view of a state in which the heat radiation fin is attached to the heat pipe structure and the heat sink is manufactured.

Base Block Forming Step

First, the recessed part 11 having the longitudinal direction and the width direction is formed in the front surface part 10*b* of the base block 10. The pair of wall parts 12*a*, 12*a* projecting in the thickness direction of the base block 10 from the width direction both sides of the recessed part 11 is formed. At the same time, the heat pipe 21 in which the second plating film is formed on the outer surface of the container part 22 of the heat pipe 21 and the first plating film is further formed on the second plating film is prepared. From the above description, a container of the heat pipe 21 has structure in which a laminated body 42 of a plating film including the first plating film and the second plating film is provided on the container part 22 outer surface. The laminated body 42 of the plating film may be provided over the entire outer surface of the container part 22 or may be provided in only a partial region of the container part 22 including the heat receiving tubular portion 21*a*. Note that, in FIGS. 5A-C, the laminated body 42 of the plating film is provided over the entire outer surface of the container part 22.

Caulking Step

In a state in which the heat receiving tubular portion 21*a* is accommodated in the recessed part 11, the pair of wall parts 12*a*, 12*a* is caulked to fix the heat pipe 21 including the heat receiving tubular portion 21*a* to the base block 10, the heat pipe 21 being the prepared heat pipe 21 including the first plating film containing the first metal having the melting point equal to or higher than 130° C. and equal to or lower than 400° C. and/or the first metal alloy having the melting point equal to or higher than 130° C. and equal to or lower than 400° C. formed on the outer surface of the container part 22 of the heat pipe 21. The heat radiating tubular portion 21*b* is in a state erected from the base block 10. Specifically, for example, the heat receiving tubular portion 21*a* of the heat pipe 21 is fit in the recessed part 11 of the base block 10 and the heat receiving tubular portion 21*a* is accommodated in the recessed part 11. At this time, the heat radiating tubular portion 21*b* is set in the state erected from the base block 10. Thereafter, a caulking part formed in a concave shape of a caulking jig (not shown in the figures) are brought into contact with distal end portions of the pair of wall parts 12*a*, 12*a*. The caulking jig is moved downward in a vertical direction (that is, a direction of the base block 10) to caulk the pair of wall parts 12*a*, 12*a*. At this time, the outer circumferential surface 21*c* of the heat receiving tubular portion 21*a* in contact with the pair of wall parts 12*a*, 12*a* receives stress on a width direction outer side from the pair of wall parts 12*a*, 12*a*. The pair of wall parts 12*a*, 12*a* is brought into press contact with the outer circumferential surface 21*c* of the heat receiving tubular portion 21*a*. When the caulking jig is further moved downward in the vertical direction to further caulk the pair of wall parts 12*a*, 12*a*, the press contact surfaces 12*c* on which the pair of wall parts 12*a*, 12*a* is in press contact with the outer circumferential surface 21*c* of the heat receiving tubular portion 21*a* is formed.

As shown in FIG. 5A, when the press contact surfaces 12*c* are formed, the heat receiving tubular portion 21*a* is caulked and fixed to the pair of wall parts 12*a*, 12*a* and the recessed part 11. As a result, the heat pipe 21 is caulked and fixed to the base block 10.

Heating Step

The heat pipe 21 fixed to the base block 10 is subjected to heating treatment at temperature equal to or higher than 130° C. and equal to or lower than 400° C., the first plating film is melted, and the first metal part 41 is formed between the recessed part 11 and the outer surface of the container part 22. In a heating step, since the first plating film is melted, a heating temperature in the heating step is temperature equal to or higher than the melting point of the first plating film. The heating temperature is set to be equal to or higher than 130° C. and equal to or lower than 400° C. according to the melting point equal to or higher than 130° C. and equal to or lower than 400° C. of the first metal and the first metal alloy forming the first metal part 41. For example, when the first plating film is a tin plating film, since a melting point of tin is 232° C., the heating temperature is set to be equal to or higher than 232° C. and equal to or lower than 400° C. On the other hand, since the melting point of the second metal and the second metal alloy forming the second metal part 51 is higher than 400° C. and equal to or lower than 1500° C., in the heating step, the second plating film, which is the second metal part 51, does not melt.

A melted object of the first metal film moves downward in a gravity direction with action of gravity. At least a part of the melted object of the first plating film intrudes into between the recessed part 11 and the second plating film (the second metal part 51) formed on the container part 22 outer surface. The first plating film located between the recessed part 11 and the second plating film (the second metal part 51) formed on the container part 22 outer surface is also melted by the heating treatment. At this time, the melted object of the first plating film intrudes into an air gap formed between the recessed part 11 of the base block 10 and the second plating film (the second metal part 51) formed on the container part 22 outer surface of the heat receiving tubular portion 21*a* including the bent parts 23 on both the sides of the heat receiving tubular portion 21*a*. The air gap is in a filled state by the melted object of the first plating film.

Thereafter, when the melted object of the first metal film is cooled, the melted object of the first metal film solidifies. The first metal part 41 containing the first metal and/or the first metal alloy having the melting point equal to or higher than 130° C. and equal to or lower than 400° C. is formed in an advanced state into the air gap. That is, it is possible to manufacture the heat pipe structure 1 shown in FIG. 5B in a state in which the air gap is filled by the first metal part 41. In the heat pipe structure 1, a region where the melted first plating film moves downward in the gravity direction and the first plating film does not remain on the container outer surface is in a state in which the second plating film forming the second metal part 51 is exposed.

Heat Radiation Fin Attaching Step

Thereafter, as shown in FIG. 5C, the heat radiation fin 31 is attached to the heat radiating tubular portion 21*b* of the heat pipe 21 fixed to the base block 10 in a state in which the first metal part 41 is formed. The heat sink 100 can be manufactured by attaching the plurality of heat radiation fins 31, 31, . . . to the heat pipe structure 1 obtained as explained above.

Thereafter, another embodiment example of the heat pipe structure of the present disclosure is explained. In the heat pipe structure 1 according to the embodiment example explained above, the first metal part 41 is formed in at least a part between the bent parts 23 on the longitudinal direction both sides of the heat receiving tubular portion 21*a* and the recessed part 11. Instead of this, a third metal part containing solder may be further formed between the first metal part 41 formed at least in a part of the bent parts 23 and the recessed part 11. Examples of the solder of the third metal part include a tin alloy and a lead alloy.

Whereas an air gap is easily formed between the bent parts 23 of the heat receiving tubular portion 21*a* and the recessed part 11 of the base block 10, since the third metal part containing solder is further formed between the first metal part 41 located in the bent parts 23 of the heat receiving tubular portion 21*a* and the recessed part 11 of the base block 10, whereby the air gap formed between the bent parts 23 of the heat receiving tubular portion 21*a* and the recessed part 11 of the base block 10 is surely filled by the first metal part 41 and the third metal part. Therefore, the heat transferability from the base block 10 to the heat pipe 21 in the caulking and fixing part is further improved. Even if the bent parts 23, fixing of which by caulking is difficult, are provided in the heat receiving tubular portion 21*a* of the heat pipe 21, since not only the first metal part 41 but also the third metal part explained above is formed in the air gap between the bent parts 23 of the heat receiving tubular portion 21*a* and the recessed part 11 of the base block 10, it is possible to surely improve the heat transferability from the base block 10 to the heat pipe 21 over the entire longitudinal direction of the heat receiving tubular portion 21*a*.

Examples of a forming method for the third metal part include a method of, in the heating step explained above, melting the solder provided in at least a part of the recessed part 11 of the base block 10 and cooling the melted solder. More specifically, for example, the heat receiving tubular portion 21*a* is accommodated in the recessed part 11 in a state in which a predetermined amount of the solder, which is a material of the third metal part, is placed in advance in positions corresponding to the bent parts 23 of the heat receiving tubular portion 21*a* in the recessed part 11 of the base block 10 or a predetermined amount of the solder, which is the material of the third metal part, is supplied to the position corresponding to the bent parts 23 of the heat receiving tubular portion 21*a* in a state in which the heat receiving tubular portion 21*a* is accommodated in the recessed part 11, and the caulking step explained above is carried out. Thereafter, the third metal part can be formed by melting the solder, which is the material of the third metal part, in the heating step and cooling the melted solder. After the caulking step is carried out, the third metal part may be formed by supplying the predetermined amount of the solder, which is the material of the third metal part, to the positions corresponding to the bent parts 23 of the heat receiving tubular portion 21*a* in the recessed part 11 of the base block 10, melting the solder, which is the material of the third metal part, in the heating step explained above, and cooling the melted solder.

In the heat pipe structure 1 according to the embodiment example, the second metal part 51, which is the second plating film, is provided on the outer surface of the container part 22 in order to impart the further function (for example, electrolytic corrosion resistance) to the outer surface of the container part 22. However, when it is unnecessary to impart the further function to the outer surface of the container part 22, the second metal part 51 does not have to be provided.

The heat pipe structure 1 according to the embodiment example includes the laminated body 42 of the plating films having the two-layer structure in which the second plating film is directly formed on the outer surface of the container part 22 of the heat pipe 21 and the first plating film is further directly formed on the second plating film. Instead of this, a plating film provided on the outer surface of the container part 22 of the heat pipe 21 may be the laminated body 42 of plating films in three or more layers. For example, another plating film may be provided between the outer surface of the container part 22 and the second plating film. Another plating film may be provided between the second plating film and the first plating film.

The heat pipe structure of the present disclosure is usable in a broad range of fields. The heat pipe structure has a high utility value in a field of cooling heat generating bodies mounted on, for example, a personal computer, a server for data centers, and transportation machines such as a railroad and an automobile. In particular, the heat pipe structure of the present disclosure is excellent in fixing stability of the heat pipe to the base block and has vibration resistance. Therefore, the heat pipe structure has a high utility value in a field of, for example, the transportation machines such as a railroad and an automobile in which a vibration load is applied to the heat sink.

What is claimed is:

1. A heat pipe structure comprising:

a base block including a rear surface part thermally connectable to a heat generating body; and a heat pipe including a heat receiving tubular portion fixed to a front surface part of the base block and disposed along an in-plane direction of the base block, wherein the base block has a longitudinal direction and a width direction and includes a recessed part in which the heat receiving tubular portion is accommodated, the recessed part in which the heat receiving tubular portion is accommodated is below the front surface part of the base block, a container part of the heat pipe is caulked and fixed in the recessed part and a first metal part containing first metal having a melting point equal to or higher than 130° C. and equal to or lower than 400° C. and/or a first metal alloy having a melting point equal to or higher than 130° C. and equal to or lower than 400° C. is formed between the recessed part and an outer surface of the container part, the base block further includes a pair of wall parts projecting along an outer circumferential surface of the heat receiving tubular portion from both sides of the recessed part, the first metal part extends from a first wall part of the pair of wall parts, passing the recessed part, to a second wall part of the pair of wall parts, the heat receiving tubular portion has a first bent part and a second bent part in the longitudinal direction of the container part, and the first bent part and the second bent part are located in the recessed part of the base block, the pair of wall parts are provided between the first bent part and the second bent part, and the first metal part is formed in a gap between an inner curved surface of the recessed part of the base block and an outer curved surface of the first bent part of the heat receiving tubular portion of the heat pipe that is not crimped and faces the base block, wherein the inner curved surface of the recessed part of the base block corresponds to the outer curved surface of the first bent part.

2. The heat pipe structure according to claim 1, the container part of the heat pipe is caulked and fixed to both the recessed part and the pair of wall parts.

3. The heat pipe structure according to claim 2, wherein a second metal part containing second metal having a melting point higher than 400° C. and equal to or lower than 1500° C. and/or a second metal alloy having a melting point higher than 400° C. and equal to or lower than 1500° C. is further formed between the outer surface of the container part and the first metal part.

4. The heat pipe structure according to claim 2, wherein the first metal is tin (Sn) or the first metal alloy is solder.

5. The heat pipe structure according to claim 2, wherein the heat pipe includes a third metal part containing solder is further formed between the first metal part formed at least in a part of the first bent part and the recessed part.

6. The heat pipe structure according to claim 5, wherein the gap formed between the first bent part of the heat receiving tubular portion and the recessed part of the base block is filled by the first metal part and the third metal part.

7. The heat pipe structure according to claim 1, wherein a second metal part containing second metal having a melting point higher than 400° C. and equal to or lower than 1500° C. and/or a second metal alloy having a melting point higher than 400° C. and equal to or lower than 1500° C. is further formed between the outer surface of the container part and the first metal part.

8. The heat pipe structure according to claim 7, wherein the second metal part is a plating film formed on the outer surface of the container part.

9. The heat pipe structure according to claim 8, wherein the second metal part contains the second metal and the second metal is at least one type selected out of a group consisting of nickel (Ni) and zinc (Zn).

10. The heat pipe structure according to claim 7, wherein the second metal part contains the second metal and the second metal is at least one type selected out of a group consisting of nickel (Ni) and zinc (Zn).

11. The heat pipe structure according to claim 1, wherein the first metal is tin (Sn) or the first metal alloy is solder.

12. The heat pipe structure according to claim 1, wherein the heat pipe includes a third metal part containing solder is further formed between the first metal part formed at least in a part of the first bent part and the recessed part.

13. The heat pipe structure according to claim 12, wherein the gap formed between the first bent part of the heat receiving tubular portion and the recessed part of the base block is filled by the first metal part and the third metal part.

14. The heat pipe structure according to claim 1, wherein an entirety of the first bent part is covered by the first metal part.

15. A heat sink comprising:

a base block including a rear surface part thermally connectable to a heat generating body;

a heat pipe including a heat receiving tubular portion fixed to a front surface part of the base block and disposed along an in-plane direction of the base block and a heat radiating tubular portion communicating with the heat receiving tubular portion and erected from the base block; and a heat radiation fin fixed to the heat radiating tubular portion, wherein the base block has a longitudinal direction and a width direction and includes a recessed part in which the heat receiving tubular portion is accommodated, the recessed part in which the heat receiving tubular portion is accommodated is below the front surface part of the base block, a container part of the heat pipe is caulked and fixed in the recessed part and a first metal part containing first metal having a melting point equal to or higher than 130° C. and equal to or lower than 400° C. and/or a first metal alloy having a melting point equal to or higher than 130° C. and equal to or lower than 400° C. is formed between the recessed part and an outer surface of the container part, the base block further includes a pair of wall parts projecting along an outer circumferential surface of the heat receiving tubular portion from both sides of the recessed part, the first metal part extends from a first wall part of the pair of wall parts, passing the recessed part, to a second wall part of the pair of wall parts, the heat receiving tubular portion has a first bent part and a second bent part in the longitudinal direction of the container part, and the first bent part and the second bent part are located in the recessed part of the base block, the pair of wall parts are provided between the first bent part and the second bent part, and the first metal part is formed in a gap between an inner curved surface of the recessed part of the base block and an outer curved surface of the first bent part of the heat receiving tubular portion of the heat pipe that is not crimped and faces the base block, wherein the inner curved surface of the recessed part of the base block corresponds to the outer curved surface of the first bent part.

16. The heat sink according to claim 15, the container part of the heat pipe is caulked and fixed to both the recessed part and the pair of wall parts.

17. The heat sink according to claim 15, wherein a second metal part containing second metal having a melting point higher than 400° C. and equal to or lower than 1500° C. and/or a second metal alloy having a melting point higher than 400° C. and equal to or lower than 1500° C. is further formed between the outer surface of the container part and the first metal part.

* * * * *